US008176600B1

(12) United States Patent
Massey, III

(10) Patent No.: US 8,176,600 B1
(45) Date of Patent: May 15, 2012

(54) MONEY PIN

(76) Inventor: Bennie Massey, III, Pascagoula, MS (US)

( * ) Notice: Subject to any disclaimer, the term of this patent is extended or adjusted under 35 U.S.C. 154(b) by 898 days.

(21) Appl. No.: 12/156,030

(22) Filed: May 29, 2008

Related U.S. Application Data

(60) Provisional application No. 60/924,682, filed on May 29, 2007.

(51) Int. Cl.
*A45F 5/02* (2006.01)

(52) U.S. Cl. ..... 24/13; 24/67 P; 24/357; 24/355; 24/351; 24/368

(58) Field of Classification Search ... 63/20; 40/661.11, 40/664, 666; 402/25; 292/307 A, 307 B; 24/67 P, 351, 355, 368, 710.3, DIG. 8, 13, 24/357

See application file for complete search history.

(56) References Cited

U.S. PATENT DOCUMENTS

| | | | | | |
|---|---|---|---|---|---|
| 587,812 | A * | 8/1897 | Grant | ..... | 402/25 |
| 958,801 | A * | 5/1910 | Gibbs | ..... | 402/25 |
| 4,241,477 | A * | 12/1980 | Freedom et al. | ..... | 24/67 P |
| 5,894,043 | A * | 4/1999 | Sood | ..... | 24/355 |

* cited by examiner

*Primary Examiner* — Robert J Sandy

(57) ABSTRACT

A money pin device is a device that conveniently and securely holds paper money and/or similar paper instruments on one's person for celebratory or suitable purposes. It also can be decoratively streamed lined and used as a simple filing system for posting receipts, notes, memos, and/or similar postings.

4 Claims, 5 Drawing Sheets

MONEY PIN

CROSS-REFERENCE TO RELATED APPLICATION

This application claim benefits from an earlier filed provision patent application filed on May 29, 2007 application No. 60/924,682.

BACKGROUND OF THE INVENTION

In the acknowledging, celebrating and sharing of special occasions such as, birthdays, anniversaries, baby showers, weddings, etc., there is a tradition of allowing others to share, acknowledge, and celebrate in these occasions by "pinning" the paper money and/or similar paper instruments, or gifts that one receives on one's person—usually the upper garment. This has been traditionally done by using a large safety pin. The safety pin has to be pinned, unpinned and re-pinned each time with each paper money or similar instrument gift received, which at best proves awkward, inconvenient and slightly hazardous. The "Money Pin" solves these problems. (In the future, throughout this document, the words "paper money and/or paper instrument" will be referred to as gift or gifts interchangeably).

BRIEF SUMMARY OF THE INVENTION

The "Money Pin" holds and secures gifts conveniently, securely and safely on one's person. The money may be attached to one's garment with a "pin back", or by using a neck lanyard, adhesive and/or any other suitable method. The "Money Pin", when opened reveals a "piercing pin" and allows gifts to be received, and upon closure, secures those gifts in place until and/or upon receiving additional gifts or until removal of gift or gifts. Because of the inherent sequential functioning of the "Money Pin", it also can be used as a simple filing system. For example, by incorporating a magnet on the "Money Pin" and attaching it to a surface such as a refrigerator door. Receipts, memos, or notes can be conveniently secured, filed or posted in chronological order.

DETAILED DESCRIPTION

The "Money Pin" can be made of plastic, light weight metal, rigid paper and/or any other similar suitable material. The "Money Pin" is comprised of parts [FIG. 2A nos. 1, 2] connected at a spring loaded or similar mechanized hinge/pivot [FIG. 2A no. 6], consisting of a "piercing pin" [FIG. 2B no. 3], and a "piercing pin housing" [FIG. 2B no. 1]. When the tabs [FIG. 3A no. 8], which are extensions from the hinged parts are compressed, the "mouth" [FIG. 2B] of the "Money Pin" opens. Upon release of the tabs, the "Money Pin" springs closed [FIG. 2A]. There is a "piercing pin" [FIG. 2B no. 3], protruding from the front side of the rear panel [FIG. 3B] of the "Money Pin" [FIG. 2B no. 2]. The "piercing pin housing" [FIG. 2 no. 1] is designed to receive the protruding "piercing pin"[FIG. 3B no. 3] through a small opening [FIG. 4B no. 9] in the back of the "piercing pin housing" which allows the protruding "piercing pin" to come to rest inside the cavity of the "piercing pin housing" when closed [FIG. 4B no. 9]. When the "money pin" is opened and paper instruments are positioned to come in contact with the "piercing pin," the "piercing pin", upon closure, penetrates through the paper money and/or similar instruments. Then, paper money or instrument is forced down to the base of the "piercing pin" by the panel surface [FIG. 3C no. 1*b*] surrounding the small opening seat [FIG. 3C no. 9], at the back of the "piercing pin housing". The gift is secured in place by the "piercing pin" [FIG. 5A no. 3] and the "Money Pin" is now ready to receive the next gift [FIG. 5C]. There can be one "piercing pin" or several "piercing pins". Although the "piercing pin housing" is a round-shaped cake design in this presentation [FIG. 5B], the "piercing pin housing" can also be a variety of shapes and/or designs to signify a special occasion. For example, the "piercing pin housing" can be the shape of a graduation cap, a fish and/or any other shaped design suitable for a special occasion. The front surface of the "piercing pin housing" of the "Money Pin" and/or the "front tab" [FIG. C no. 8], may be reserved for custom-tailored imprinted text to signify the special occasions [FIG. 5C no. 12]: "It's my retirement," "It's My Birthday," "It's My Anniversary," "My Baby Shower," etc. The "Money Pin" can be attached on one's person by pinning it to one's garment with a "pin back [FIG. 3C no. 4], or by using a neck lanyard, adhesive, and/or other suitable methods. As for its' secondary use as a simple filing or posting system, the "Money Pin" can be equipped with a magnet or adhesive for the appropriate vertical surfaces or may be laid down horizontally flat on a desk, table or similar planes [FIG. 5A].

Figure 1A:
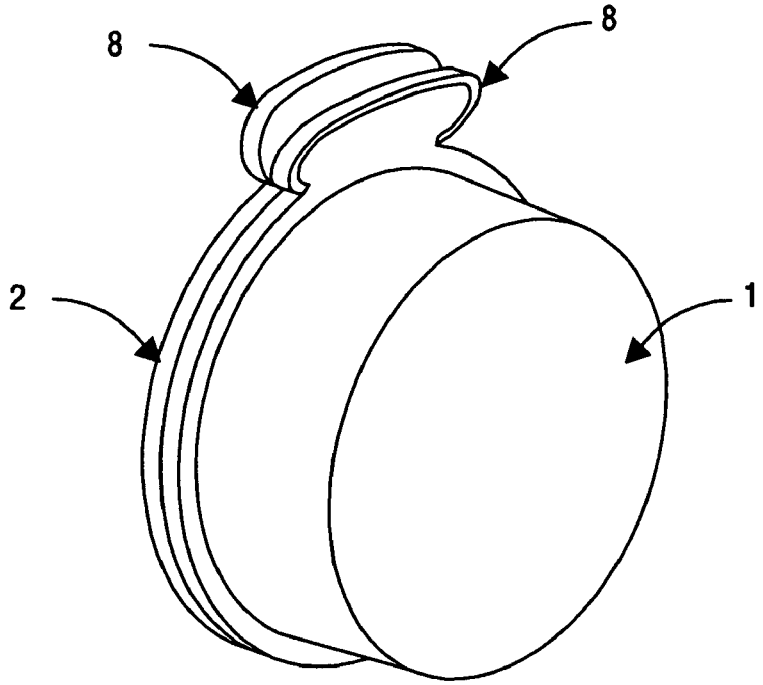
FIG. 1A: The "Money Pin" shown in upright vertical position and closed in a no-frills state.
Figure 1B:
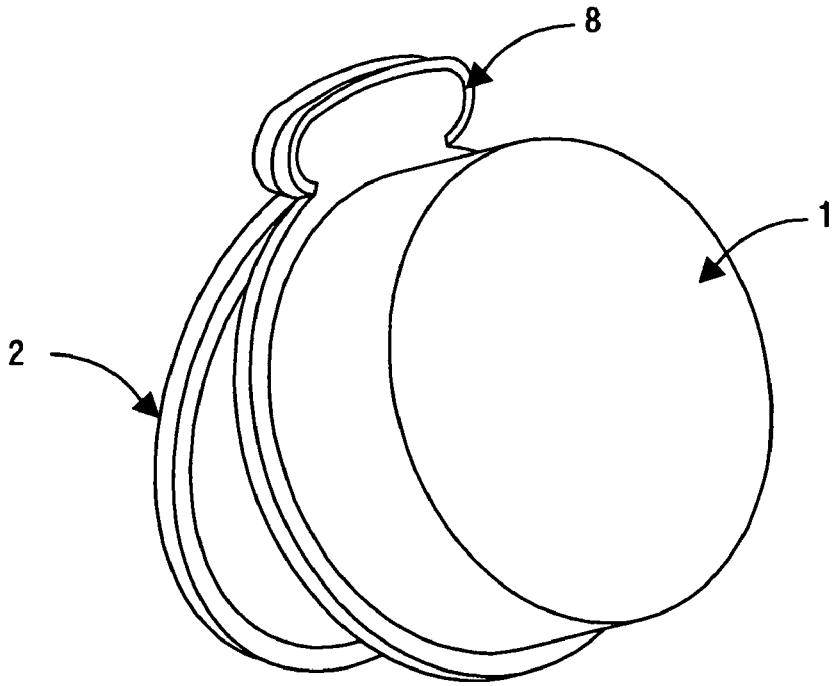
FIG. 1B: The "Money Pin" is shown in upright vertical position, opened, in a no-frills state.
Figure 2A:
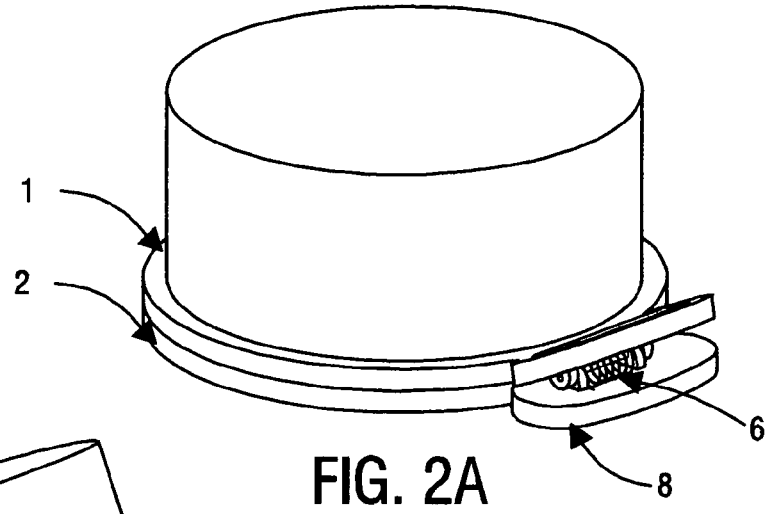
FIG. 2A: The "Money Pin" is shown in the horizontal view and in the closed position with the top orientation.
Figure 2B:
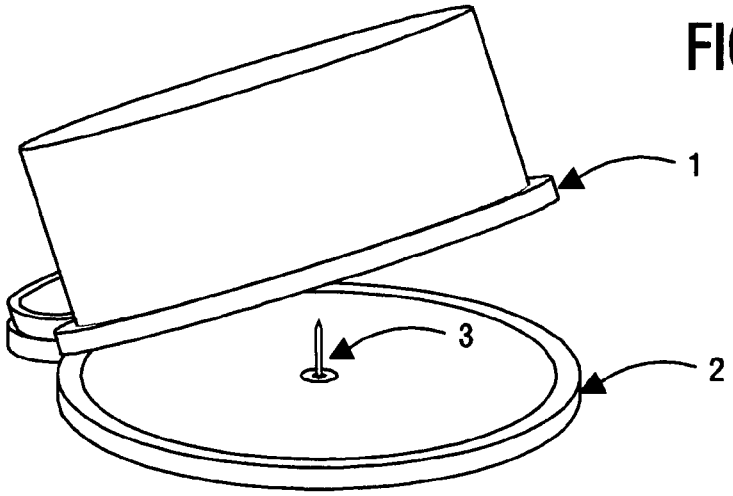
FIG. 2B: The "Money Pin" in the horizontal view and open with bottom orientation.
Figure 2C:
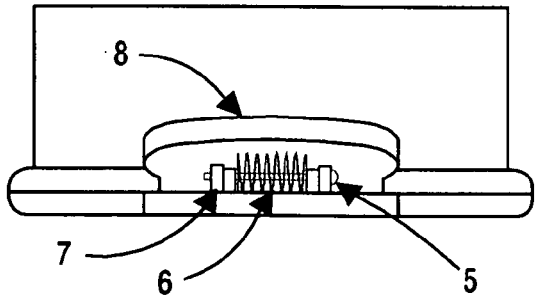
FIG. 2C: The "Money Pin" is shown from a top view.
Figure 3A:
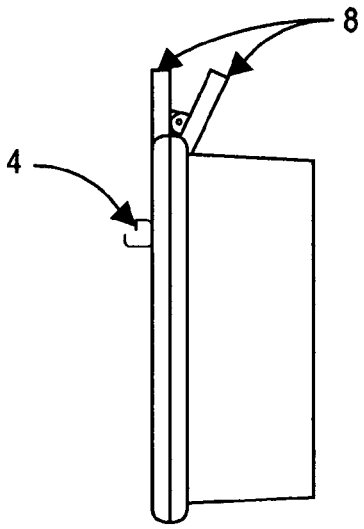
FIG. 3A: The Money Pin" is shown from a side view and in the closed position.
Figure 3B:
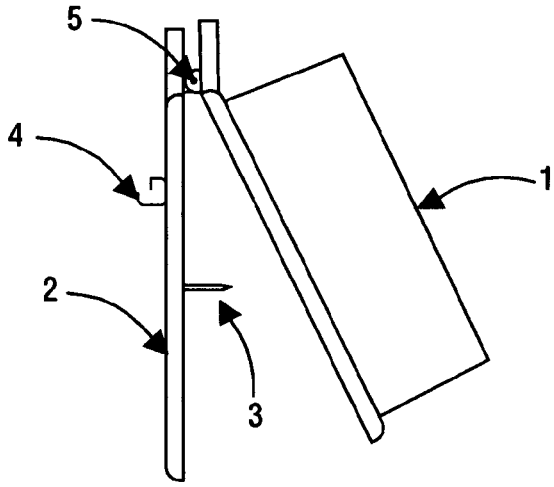
FIG. 3B: The "Money Pin" shown from a side view and in its opened position.
Figure 3C:
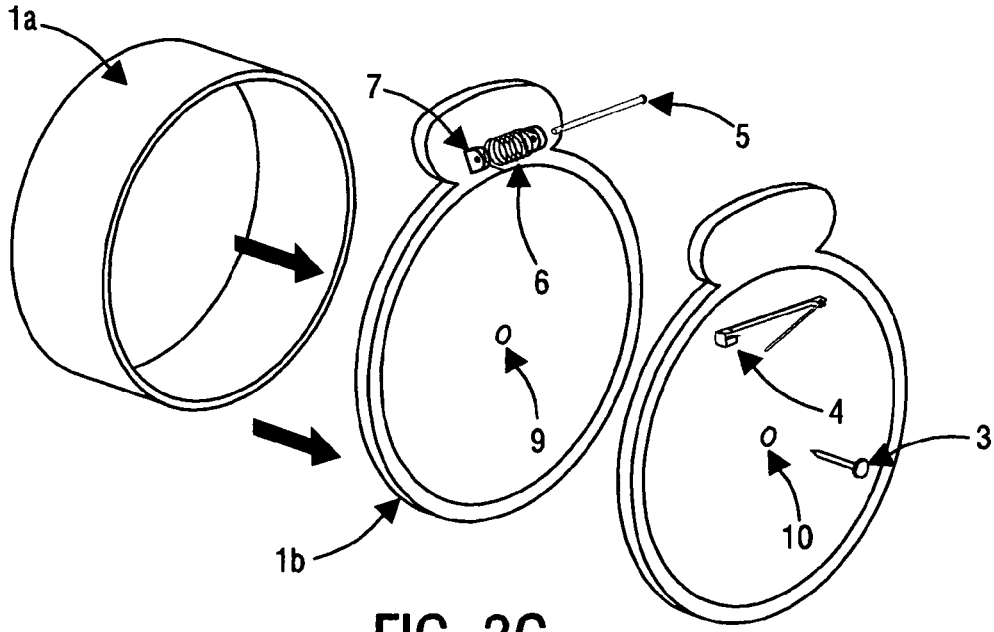
FIG. 3C: The "Money Pin" is shown in an exploded view.
Figure 4A:
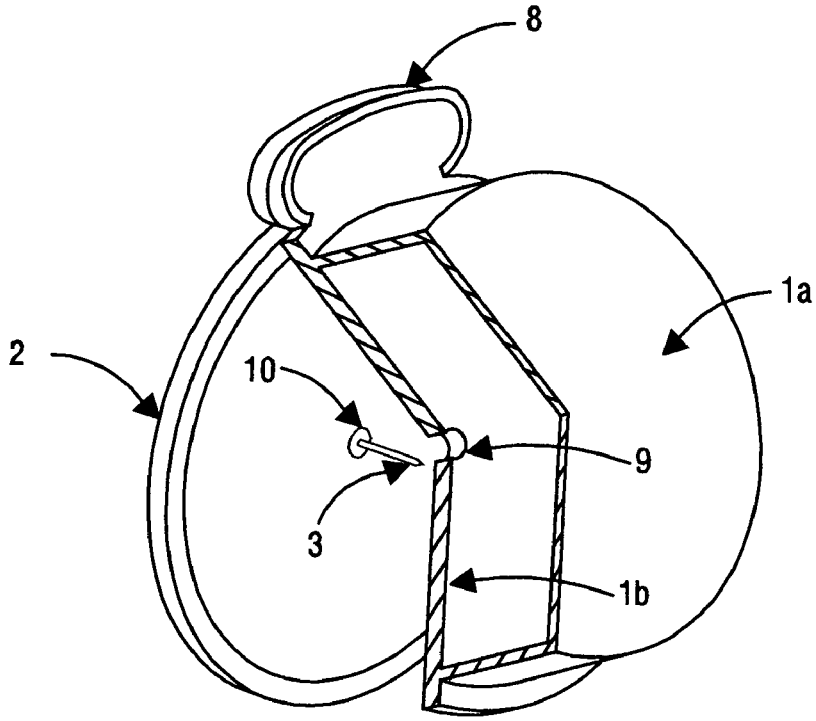
FIG. 4A: The "Money Pin" is shown in a cut-a-way view and opened.
Figure 4B:
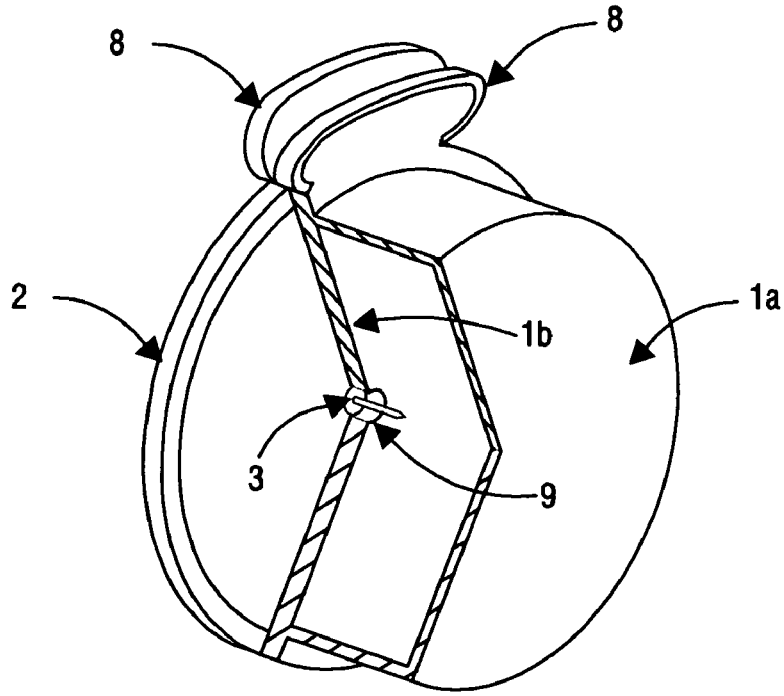
FIG. 4B: The "Money Pin" is shown in a cut-a-way view and closed.
Figure 5A:
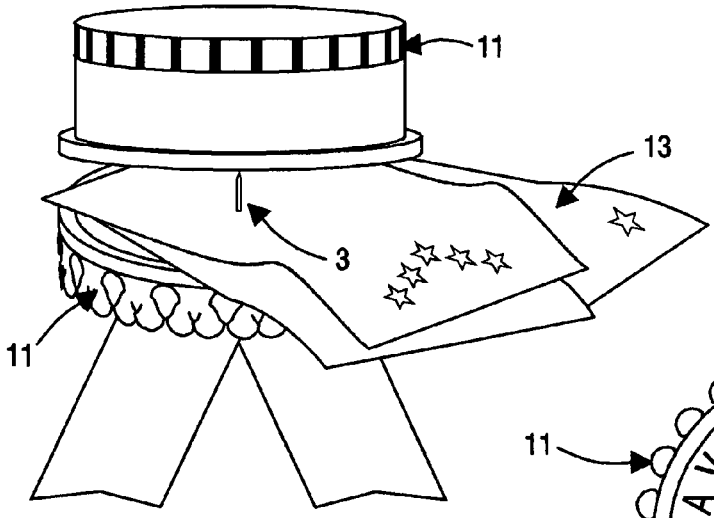
FIG. 5A: The "Money Pin" is shown in a horizontal/laid-down view of the "Money Pin" in its opened position with penetrated paper instruments resting at the base of the "piercing pin" in one of many possible "Money Pin's" decorative state.
Figure 5C:
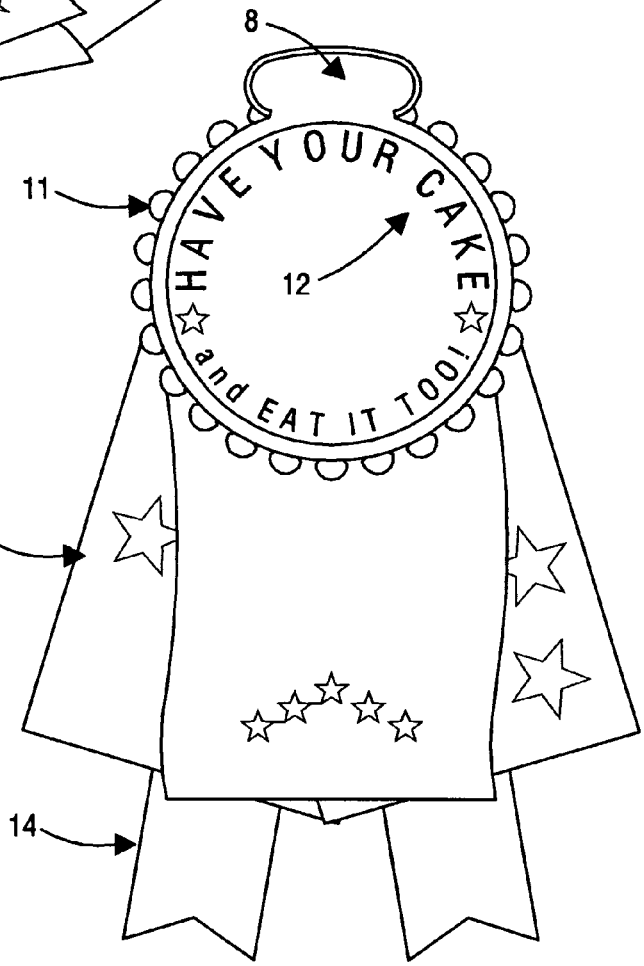
FIG. 5C: The "Money Pin" is shown in its' vertical upright position as it would be worn on one's person. The "Money Pin's" here is shown in one of many possible decorative states.
Figure 5B:
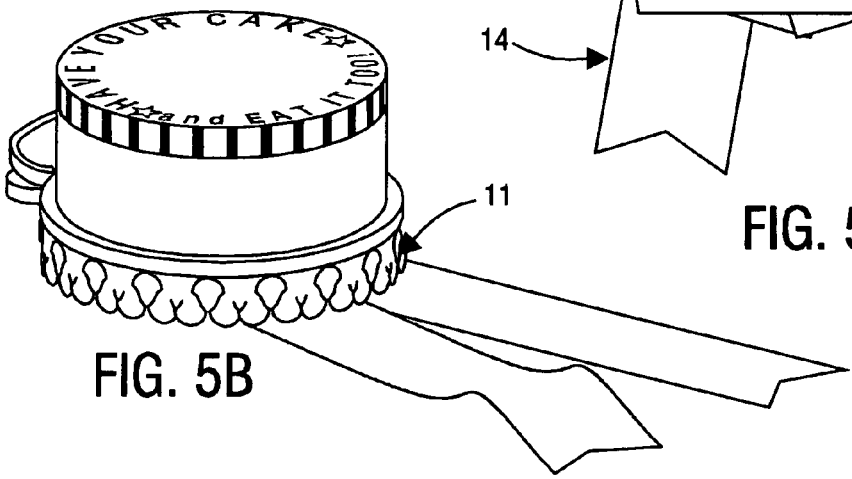
FIG. 5B: The "Money Pin" is shown in a horizontal/laid-down view in its closed position, in one of many possible decorative states.

1. PIERCING PIN HOUSIING
2. REAR PANEL
3. PIERCING PIN
4. PIN BACK
5. HINGE PIN
6. HINGE SPRING
7. HINGE COLLAR
8. COMPRESSION TAB
9. OPENING SEAT FOR PIERCING PIN

-continued

| | |
|---|---|
| 10. | PIERCING PIN SEAT |
| 11. | DECORATIVE EMBELLISHMENTS |
| 12. | SPECIAL OCASSION IMPRINTS |
| 13. | PIERCED AND SECURED PAPER INSTRUMENTS OR GIFTS |
| 14. | RIBBON EMBELLISHMENT |

I claim

1. A money pin device for conveniently receiving and securing paper instruments such as paper money, ribbons, receipts, memos, and notes, the device comprising:

a rear panel including a receiving portion having a rear planar surface, a front planar surface, and an operating tab extending from the receiving portion of the rear panel;

a piercing pin housing including a receiving portion having a front wall surface, a rear wall surface, and an operating tab extending from the receiving portion of the piercing pin housing;

a spring biased hinge pivotally connecting the rear panel to the piercing pin housing, and biasing the money pin device in a closed position, and wherein compression of the operating tabs toward each other causes pivotal rotation of the receiving portions away from each other to an open position of the money pin device to provide a receiving space for receiving the paper instruments;

the rear panel further including at least one piercing pin extending from the front surface of the rear panel, and the rear surface of the rear panel being provided with an attaching pin for attaching the money pin device onto a garment; and the rear wall surface of the piercing pin housing being provided with at least one opening seat extending into the piercing pin housing, each one of the at least one opening seats for receiving a respective one of the at least one piercing pins when the money pin device is operated from the open position to the closed position, the at least one piercing pin for piercing through the paper instruments to secure the paper instruments between the respective receiving portions of the rear panel and the piercing pin housing.

2. The money pin device according to claim 1, wherein the device is made of plastic, light weight metal, or rigid paper.

3. The money pin device according to claim 2, wherein the pin piercing housing has a decorative shape to signify a special occasion, such as the shape of a graduation cap or a fish.

4. The money pin device according to claim 3, wherein the front wall surface of the piercing pin housing is provided with imprinted text to signify a special occasion, such as a birthday, an anniversary, a graduation, a baby shower, or a retirement.

* * * * *